US008899919B2

(12) United States Patent
Heinzelmaier et al.

(10) Patent No.: US 8,899,919 B2
(45) Date of Patent: Dec. 2, 2014

(54) METHOD FOR REPAIRING A ROTOR SYSTEM OF A TURBOMACHINE, ANNULAR ELEMENT FOR A ROTOR SYSTEM OF A TURBOMACHINE, AND ROTOR SYSTEM FOR A TURBOMACHINE

(75) Inventors: Christian Heinzelmaier, Puchheim (DE); Michael Raiche, Munich (DE); Knut Werner, Munich (DE)

(73) Assignee: MTU Aero Engines GmbH, Munich (DE)

( * ) Notice: Subject to any disclaimer, the term of this patent is extended or adjusted under 35 U.S.C. 154(b) by 852 days.

(21) Appl. No.: 13/066,526

(22) Filed: Apr. 15, 2011

(65) Prior Publication Data

US 2011/0255980 A1 Oct. 20, 2011

(30) Foreign Application Priority Data

Apr. 19, 2010 (DE) ..... 10 2010 015 404

(51) Int. Cl.

*F04D 29/34* (2006.01)
*F01D 5/00* (2006.01)
*F01D 5/02* (2006.01)

(52) U.S. Cl.

CPC *F01D 5/005* (2013.01); *F01D 5/02* (2013.01); *F05D 2230/80* (2013.01)
USPC ..... 416/1; 416/204 R

(58) Field of Classification Search

CPC ..... F01D 5/005; F01D 5/10; F01D 5/30; F01D 5/3015; F01D 5/3023; F01D 5/303; F01D 5/326; F05D 2230/10; F05D 2230/60; F05D 2230/80
USPC ..... 416/204 R, 204 A, 215, 216, 218, 220 R, 416/1; 29/889.1, 402.04, 402.05, 402.06, 29/402.13, 402.16
See application file for complete search history.

(56) References Cited

U.S. PATENT DOCUMENTS

| | | | | |
|---|---|---|---|---|
| 3,501,249 | A * | 3/1970 | Scalzo et al. | 416/95 |
| 3,656,865 | A * | 4/1972 | Spears, Jr. | 416/221 |
| 5,123,813 | A | 6/1992 | Przytulski | |
| 5,263,823 | A * | 11/1993 | Cabaret et al. | 416/218 |
| 5,733,103 | A * | 3/1998 | Wallace et al. | 416/248 |
| 2002/0018719 | A1 * | 2/2002 | Arilla et al. | 416/220 R |
| 2004/0062643 | A1 * | 4/2004 | Brauer et al. | 415/173.7 |
| 2005/0175459 | A1 * | 8/2005 | Gagner | 416/204 R |
| 2007/0020089 | A1 * | 1/2007 | Forgue et al. | 415/119 |
| 2008/0008593 | A1 * | 1/2008 | Zagar et al. | 416/220 R |

(Continued)

FOREIGN PATENT DOCUMENTS

| | | |
|---|---|---|
| DE | 10163951 | 12/2011 |
| EP | 2149677 | 2/2010 |

*Primary Examiner* — Edward Look
*Assistant Examiner* — Aaron R Eastman
(74) *Attorney, Agent, or Firm* — Davdison, Davidson & Kappel, LLC

(57) ABSTRACT

A method for repairing a rotor system (2) of a turbomachine, having a rotor (4) which has a groove (26) extending in the circumferential direction (58) of the rotor for accommodating an annular section (18; 28). The method has the following steps: chamfering a notch (40) in the groove (26); introducing a recess (44) into the groove (26); and inserting the annular section (18; 28) into the groove (26). At least one engagement element (48; 49) formed on the annular section (18; 28) engages in the recess (44) in order to form a lock against rotation in the circumferential direction (58).

16 Claims, 6 Drawing Sheets

(56) References Cited

U.S. PATENT DOCUMENTS

2009/0004018 A1* 1/2009 Dejaune et al. ..... 416/219 R
2009/0053064 A1* 2/2009 Ress, Jr. ..... 416/214 A
2011/0123341 A1* 5/2011 Aubin et al. ..... 416/220 R
2012/0027598 A1* 2/2012 Caprario ..... 416/193 R
2013/0224030 A1* 8/2013 Kimura et al. ..... 416/220 R

* cited by examiner

METHOD FOR REPAIRING A ROTOR SYSTEM OF A TURBOMACHINE, ANNULAR ELEMENT FOR A ROTOR SYSTEM OF A TURBOMACHINE, AND ROTOR SYSTEM FOR A TURBOMACHINE

This claims the benefit of German Patent Application DE 10 2010 015 404.0, filed on Apr. 19, 2010 and hereby incorporated by reference herein.

The present invention relates to a method for repairing a rotor system of a turbomachine, an annular element for a rotor system of a turbomachine, and a rotor system for a turbomachine.

SUMMARY OF THE INVENTION

Although applicable to any given turbomachines, the present invention and its underlying background are explained in greater detail with regard to a rotor system for a high-pressure compressor.

FIGS. 5 through 8 of the drawing show a rotor system 2 for a high-pressure compressor which is known to the present applicant from internal sources.

As shown in FIG. 5, rotor system 2 has a rotor 4. Rotor system 2 also has blades 6, 8. As an example, FIG. 5 shows in each case only one blade 6, 8 of a row of blades which are each situated along the circumference of rotor 4. In a first region of two regions 10, 12 of rotor system 2, blades 6 are each held in axial grooves 14 in rotor 4 in a positive-fit manner in the radial direction, for example with the aid of a dovetail or fir-tree connection, for example. In the present context, the terms "axial," "radial," and "in the circumferential direction" refer to a center axis 16 of rotor 4. To prevent blades 6 from slipping out of their grooves 14 in the axial direction, retaining plates 18 in the form of annular sections are situated in a groove 20 in rotor 4 which extends in the circumferential direction, and in a groove 22 for each blade 6 which extends in the circumferential direction, thus ensuring a positive fit between each blade 6 and rotor 4 in the axial direction. For the sake of clarity, FIG. 5 shows only one of multiple retaining plates 18 which are situated along the circumference in grooves 20 and 22. In addition, multiple locking plates (not illustrated) are usually provided, each of which is situated in a gap between two retaining plates 18. The essential difference between the locking plates and retaining plates 18 is that, unlike the retaining plates 18, the locking plates are not inserted into grooves 20, 22 along the circumference, but instead are driven into grooves 20 and 22 by shaping the locking plates.

In second region 12, rotor 4 is provided with grooves 24 which extend in the circumferential direction and which engage with blades 8 in a positive-fit manner in the radial direction, for example with the aid of a dovetail or fir-tree connection. In second region 12, rotor 4 viewed in the longitudinal direction has grooves 26, in front of and behind each row of blades 8, which extend in the circumferential direction of the rotor. Grooves 26 are also illustrated in FIG. 6, which shows a sectional view A from FIG. 5. A damper ring 28 is situated in each of grooves 26, as is apparent from FIG. 6. For better understanding, FIG. 6 illustrates only two of the grooves 26 together with damper rings 28.

FIG. 7 shows damper ring 28 in an enlarged top view B from FIG. 6. For installation on rotor 4, damper ring 28 has a divided design over a portion of its circumference, and forms the two ends 30 and 32, each of which is chamfered. Damper rings 28 move relative to rotor 4 and blades 8 during the rotation of rotor system 2. The resulting friction damps undesired vibrations of rotor system 2.

FIG. 8 illustrates an enlarged partial view C from FIG. 6. Groove 26 is formed by two oppositely situated flanges 34 and 36 and a base 38. The original state of groove 26 is illustrated in dashed lines in FIG. 8. As the result of the presently described relative motion between damper ring 28 and rotor 4, in particular ends 30 and 32 of damper ring 28 then sink into flanges 34, 36 of groove 26. This results, for example, in a notch 40 in flange 36. If this notch 40 exceeds predefined dimensions, the notch is advantageously to be chamfered. This is usually achieved by removing material which surrounds the notch, for example with the aid of a milling head or grinding head. The chamfered region is illustrated by reference numeral 42 in FIG. 8. After the chamfering, damper ring 28 is reinserted into groove 26, and rotor system 2 is placed back into operation. During operation, ends 30 and 32 of damper ring 28 become increasingly caught in chamfered region 42, so that within a short period of time a notch forms again; i.e., there is the risk that an end of damper ring 28 may pass by blades 8 in the axial direction. If sufficient material is still available for further chamfering, the rotor is repaired once again. Otherwise, it may be necessary to completely replace the rotor. In particular in the latter case, however, this results in very high costs, since the rotor body is manufactured from titanium in a very complicated process.

A similar problem results for retaining plates 18 and the securing plates (not illustrated), whose corners and edges in particular likewise sink into grooves 20 and form notches there; i.e., there is the risk that a retaining plate 18 may pass by blades 8 in the axial direction or be damaged. It is current practice to eliminate the notches in grooves 20 similarly as described above for groove 26, which likewise results in the problem of the above-described renewed notch formation.

It is an object of the present invention to provide an improved repair method, an improved annular element, and/or an improved rotor, thus prolonging the service life of a rotor of the rotor system.

The present invention provides a method for repairing a rotor system of a turbomachine, having a rotor which has a groove extending in the circumferential direction for accommodating an annular section, is provided, having the following steps: in a first step a notch is chamfered in the groove. A recess is introduced into the groove beforehand, at the same time, or afterwards. The annular section is then inserted into the groove, at least one engagement element formed on the annular section engaging in the recess in order to form a lock against rotation in the circumferential direction.

In addition, the present invention provides an annular element for a rotor system of a turbomachine which has the following: an annular section which is designed to be inserted into a groove that extends in the circumferential direction of a rotor of the rotor system; and at least one engagement element which is designed to engage in a recess in the groove in order to form a lock against rotation in the circumferential direction.

Furthermore, the present invention provides a rotor system for a turbomachine which has the following: a rotor which has a groove that extends in the circumferential direction, the groove being provided with a recess; and the annular element according to the present invention, the annular section of which being inserted into the groove and the at least one engagement element engaging in the recess, and together with same forming a lock against rotation in the circumferential direction.

The concept on which the present invention is based is to prevent a relative motion between the annular section and the groove in the circumferential direction. For the case that the annular section is designed as a damper ring, for example, this has the advantage that with the aid of the lock against rotation in particular the ends of the damper ring may no longer be introduced into the chamfered region or an arbitrary region, thus prolonging the service life of the rotor. For the case that the annular section is designed as a retaining plate or securing plate, for example, the advantage results that due to the lock against rotation in particular the corners or edges of the retaining plates or securing plates are no longer able to sink into or disappear in the chamfered region, here as well thus allowing the service life of the rotor to be prolonged.

When the advantage of the present invention is realized in particular when a chamfered region is already present in the groove in which the ends of the damper ring or the corners and edges of the retaining plates or of the securing plates are able to sink in, it is likewise a concept of the present invention to provide the rotor system with the lock against rotation between the annular section and the rotor at the outset, and not to provide same just in the repair method.

In the present context, an "annular section" is understood in particular to mean a damper ring, a retaining plate for a blade, or a locking plate, in each case for a rotor system of a turbomachine.

In the present context, a "notch" is understood in particular to mean a flaw in the material of the rotor which, if not corrected, may result in failure of the rotor.

In the present context, a "recess" is preferably understood to mean a pocket or an opening.

According to one preferred refinement of the method according to the present invention, the at least one engagement element is mounted, in particular welded or soldered, on the annular section before the annular section is inserted into the groove. Thus, the existing annular section advantageously is not replaced by a new annular section on which the at least one engagement element is mounted. Rather, the existing annular section is to be initially removed from the groove, after which the notch is chamfered, the recess is introduced, and the annular section which is provided with an engagement element is then once again inserted into the groove. With the aid of this refinement, it is advantageous that fewer annular sections, which are comparatively costly, are required.

For example, one, two, or four engagement elements may be provided.

According to another preferred refinement of the method according to the present invention, the at least one engagement element is formed by shaping, in particular upward bending, of a partial region of the annular section. The same as for the preceding refinement, for the present refinement it is advantageously provided to reuse the original annular section. In addition, according to this refinement the at least one engagement element is formed by the annular section itself, thus allowing additional components to be dispensed with.

According to another preferred refinement of the method according to the present invention, the recess is introduced into a flange in the groove opposite from the notch in such a way that a tool for chamfering the notch is movable essentially in a straight line through the recess to the notch. According to this refinement, the recess has a dual function: on the one hand a tool, for example a milling head, is provided with good accessibility to the notch in order to chamfer same. On the other hand, the recess is used as a counterpart for the engagement element and thus ensures the described lock against rotation.

According to another preferred refinement of the annular element according to the present invention, the at least one engagement element is designed as a hump which extends from the annular section in the axial direction thereof. Such a hump is well suited for cooperating with a corresponding recess in the flange of the groove.

According to another preferred refinement of the annular element according to the present invention, the annular section is provided with two first interspaced engagement elements which are designed to lie against oppositely situated ends of the recess after the annular section has been inserted into the groove. The aim is to provide lock against rotation in both circumferential directions, i.e., in the clockwise and counterclockwise directions. Since in some cases the region to be chamfered extends over a comparatively long circumferential length and the recess therefore also has a corresponding length, it would appear to be appropriate to also provide an engagement element having a corresponding length. However, since this results in a high weight, according to this refinement it is provided to divide the engagement element into two engagement elements having only a small length in the circumferential direction of the ring, the engagement elements being situated in such a way that they lie against oppositely situated ends of the recess after the annular section has been inserted into the groove. Of course, it is also conceivable to provide the recess at any other given region of the flange or also of the base of the groove, i.e., not necessarily opposite from the notch.

According to another preferred refinement of the annular element according to the present invention, the annular section is designed as a damper ring, a retaining plate for at least one blade of the rotor system, or a locking plate of the rotor system.

BRIEF DESCRIPTION OF THE DRAWINGS

The present invention is explained in greater detail below based on exemplary embodiments, with reference to the appended figures of the drawing.

DETAILED DESCRIPTION

Figure 1:
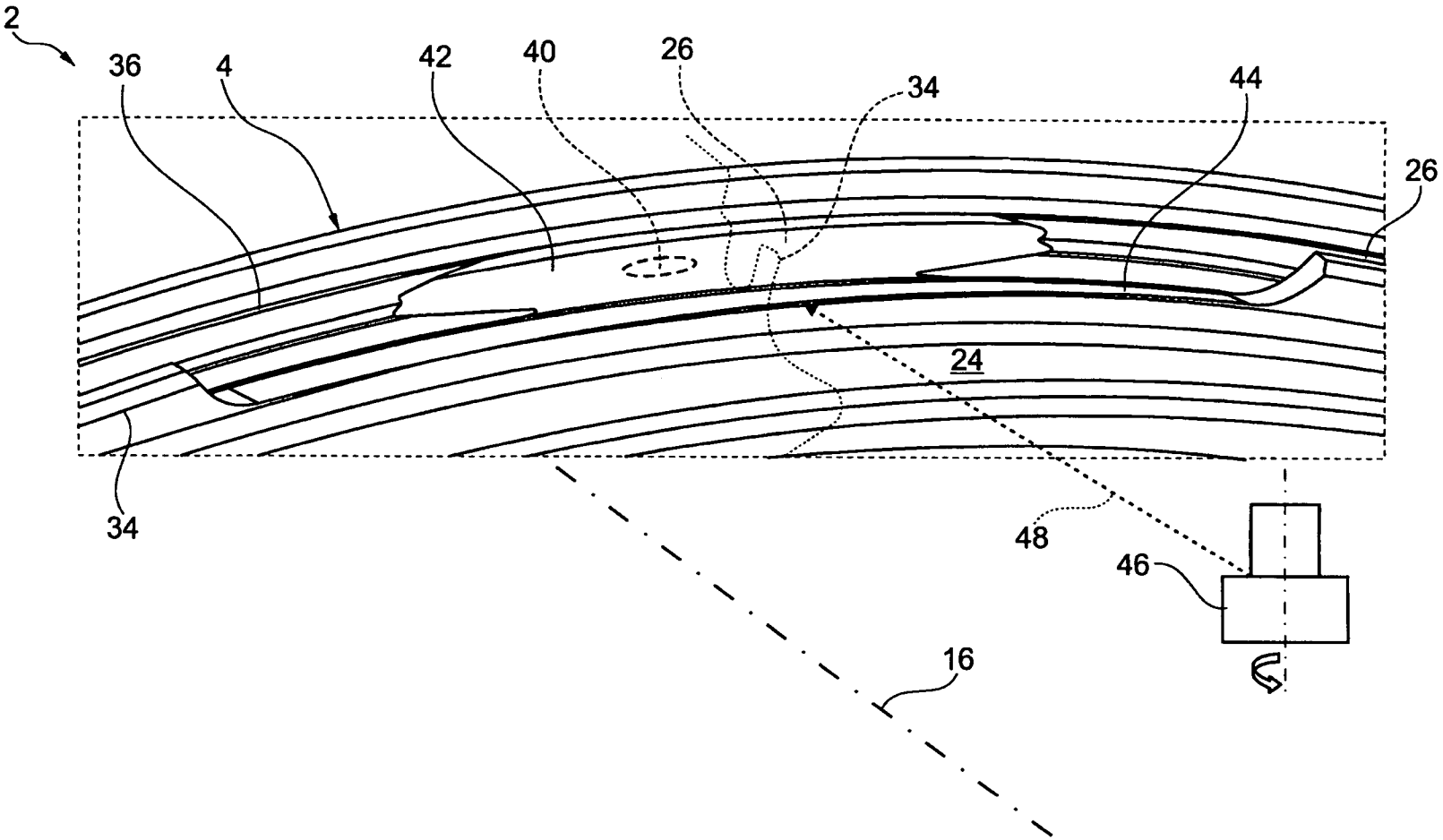
FIG. 1 shows a perspective view of a groove having a chamfered notch and a recess according to one exemplary embodiment of the present invention.

Unless indicated otherwise, identical or functionally equivalent components are denoted by the same reference numerals in the figures.

Figure 8:
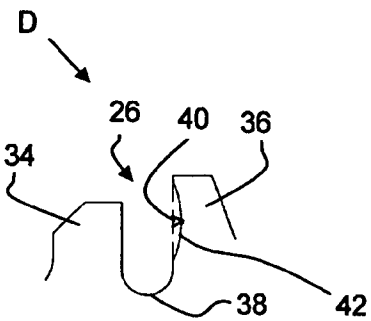
FIG. 8 shows an enlarged view C from FIG. 6.

FIG. 1 is based on a perspective view D from FIG. 8. Therefore, in the explanation below at least partial reference is made to the description in conjunction with FIGS. 5 through 8. A contour of the state of rotor 4 having notch 40, as illustrated in FIG. 8, is shown in dashed lines in FIG. 1. Damper ring 28 has already been removed from groove 26 in FIG. 1. This state is the starting point for the following description.

Initially, groove 26 is usually cleaned and a search is made for notches 40. If a notch 40 as illustrated in FIG. 1 is found, in a next step a continuous recess 44 is milled into flange 34 opposite from flange 36 which has notch 40, for example with the aid of a milling head 46. The extension of recess 44 in the circumferential direction preferably corresponds at least to the extension of region 42 to be chamfered in the circumferential direction.

In a further step, milling head 46 or another tool, for example a grinding head, is moved in arrow direction 48 illustrated in FIG. 1 through formed recess 44, essentially at a right angle to flange 36, in order to chamfer notch 40 and thus form chamfered region 42.

Figure 2:
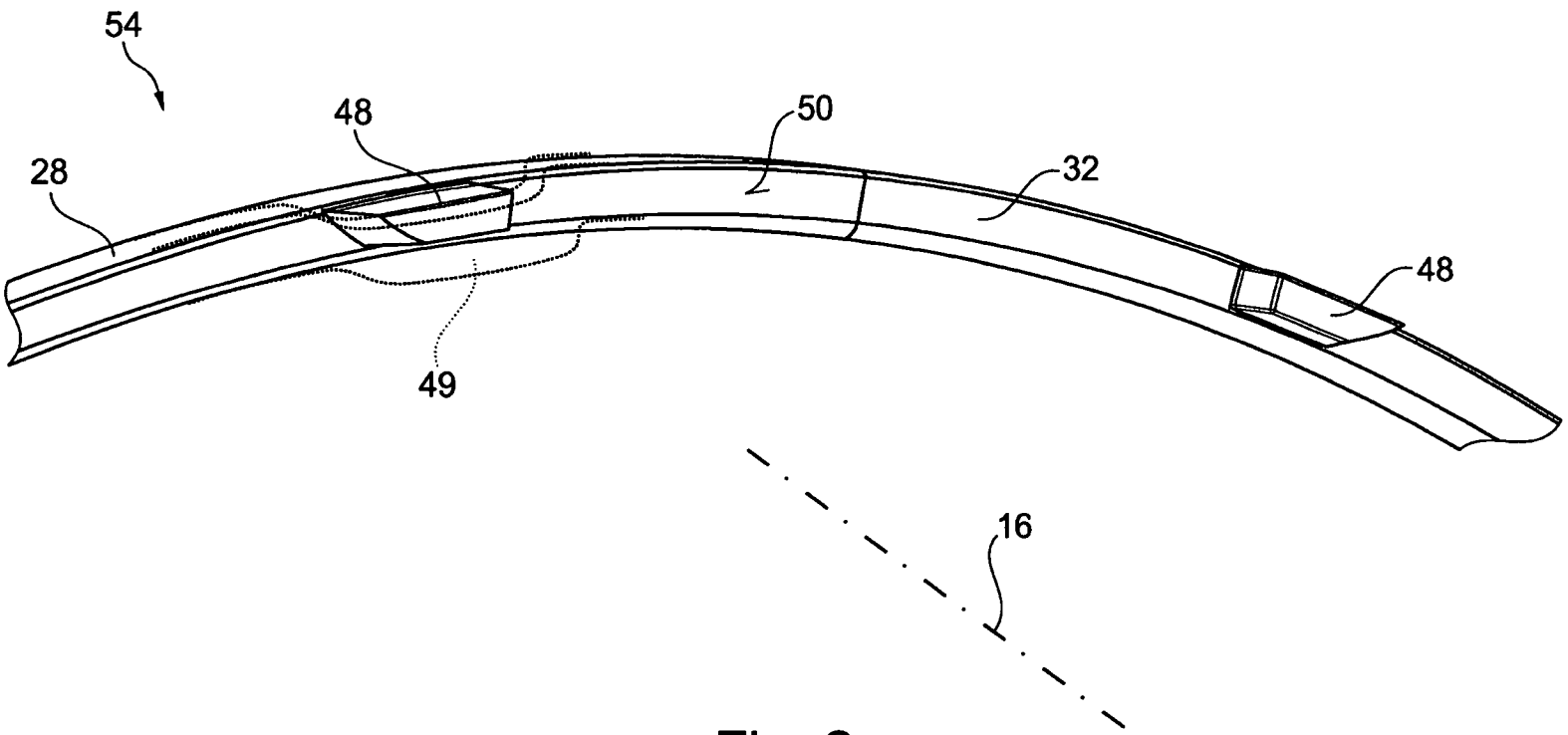
FIG. 2 shows a perspective view of a section of an annular element according to one exemplary embodiment of the present invention.
Figure 3:
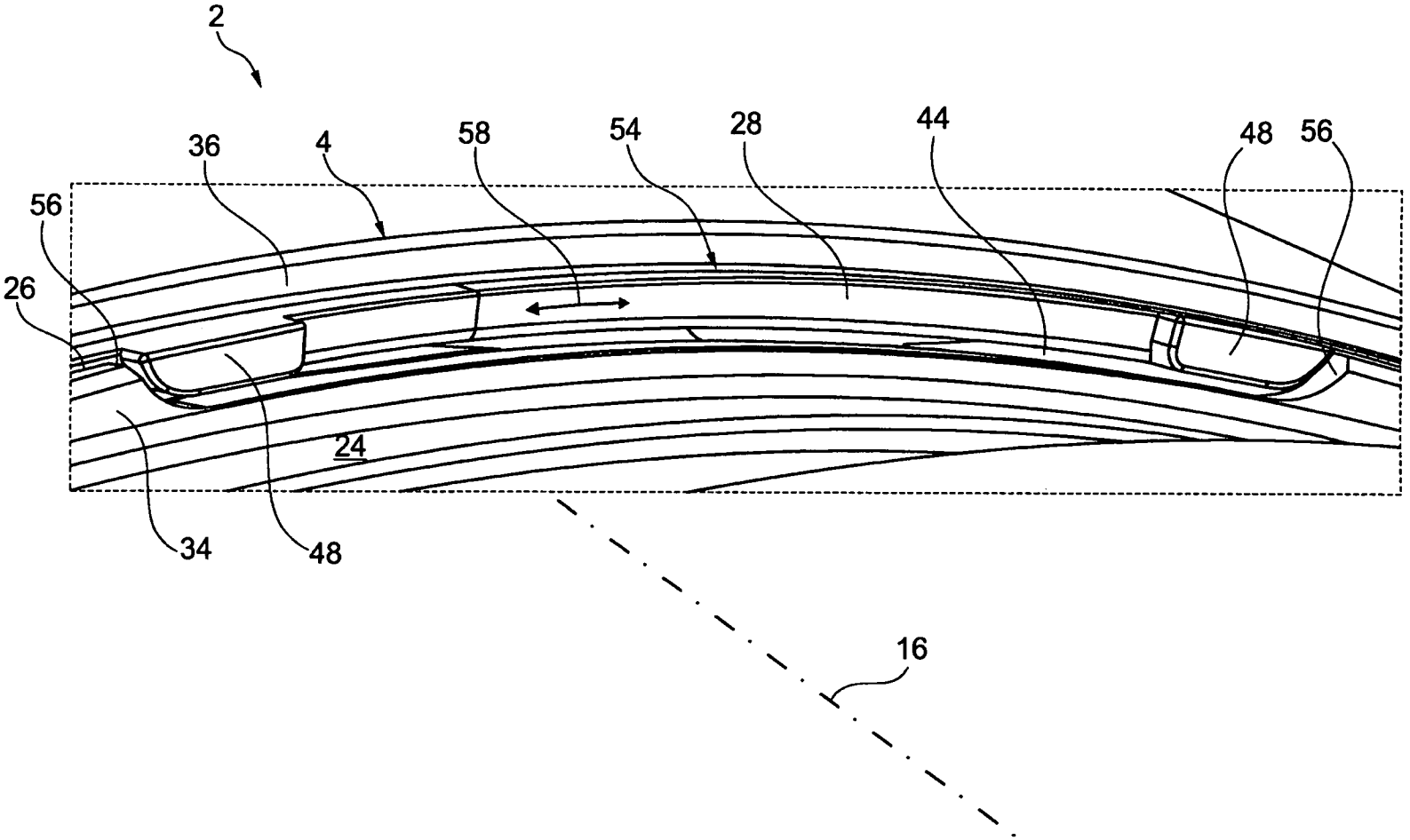
FIG. 3 shows the view from FIG. 1, with the annular element from FIG. 2 inserted into the groove.

Before, during, and/or after the above-described steps, two engagement elements 48 in the form of humps are welded or soldered to damper ring 28 after it has been removed from groove 26, as illustrated in FIG. 2. In their welded-on state, humps 48 preferably extend from a lateral face 50 of damper ring 28 in the axial direction. In addition, humps 48 are situated on different sides of a separating point for opening damper ring 28, as described above in conjunction with FIG. 7. Damper ring 28 together with engagement elements 48 form an annular element 54.

Alternatively, the engagement elements may each be produced by upwardly bending a partial region 49 of damper ring 28, for example in the axial direction as shown in FIG. 2. Upwardly bent partial region 49 is shown in dashed lines in FIG. 2, and is illustrated at only one location on damper ring 28. However, it is also possible to produce multiple upwardly bent partial regions, for example corresponding to the arrangement of humps 48 in FIG. 2.

Figure 4:
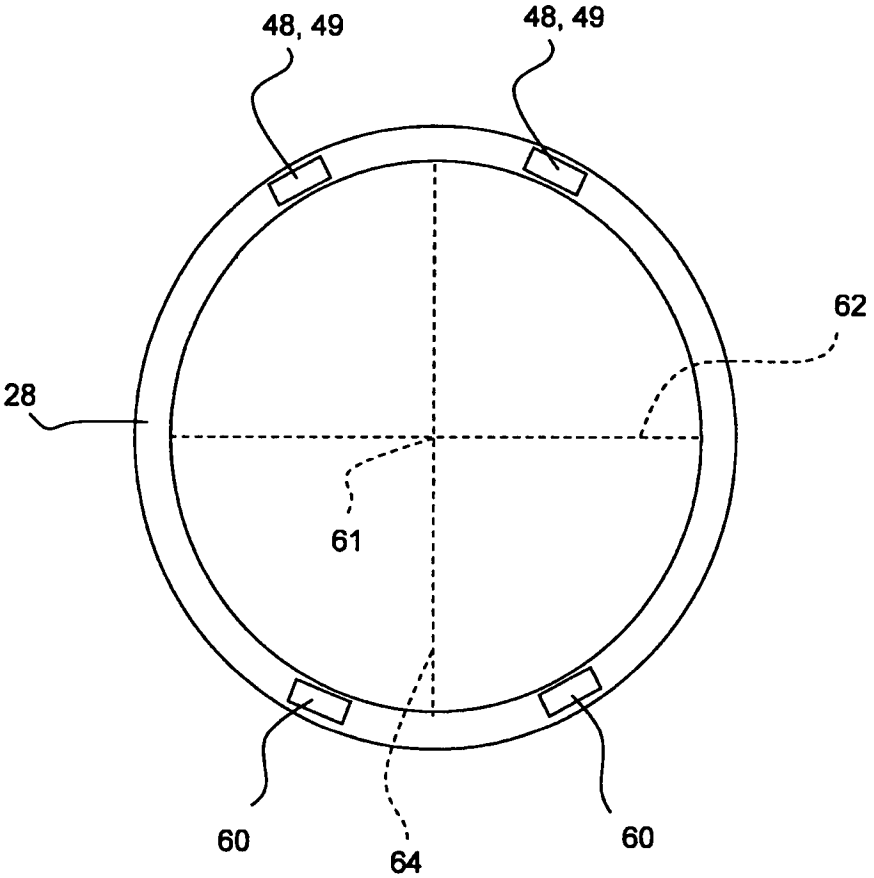
FIG. 4 shows the annular element from FIG. 2 in a view along its center axis.
Figure 5:
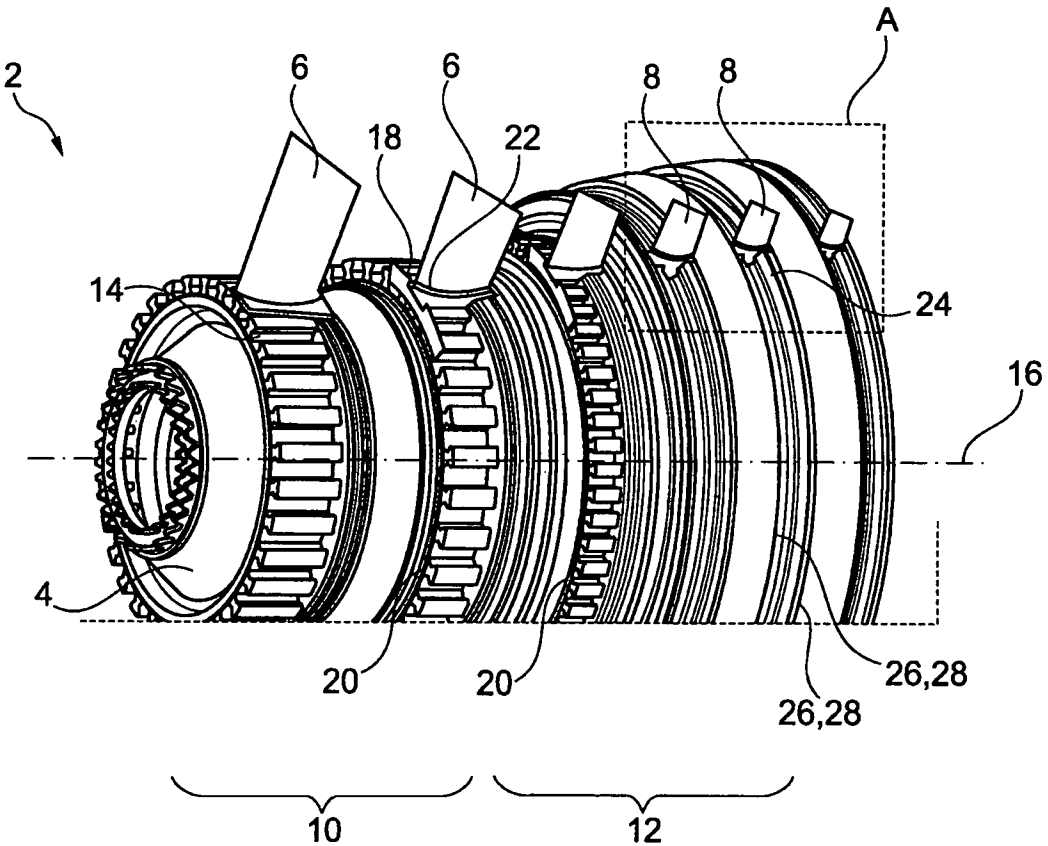
FIG. 5 shows a perspective view of a rotor system known to the present applicant from internal sources.
Figure 7:
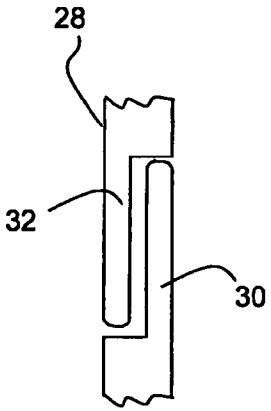
FIG. 7 shows an enlarged top view B from FIG. 6.
Figure 6:
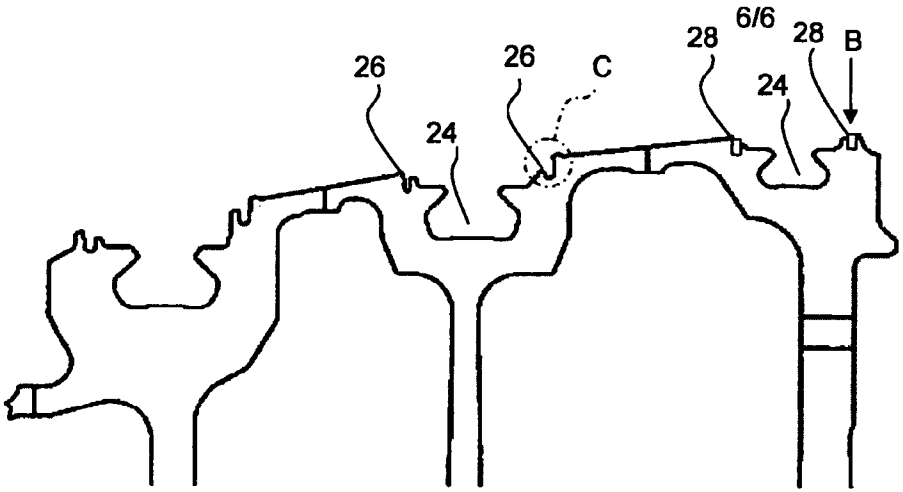
FIG. 6 shows a sectional view A from FIG. 5.

Damper ring 28 may also be formed using two further engagement elements 60, for example in the form of humps or upwardly bent partial regions, as illustrated in FIG. 4. Engagement elements 60 engage in a recess in flange 34 which is correspondingly provided in recess 44 and essentially oppositely situated. According to the present exemplary embodiment, engagement elements 48 or 49 and 60 are situated on damper ring 28 mirror-symmetrically with respect to two mutually perpendicular axes 62, 64 which intersect ring center point 61, and have approximately the same dimensions. An imbalance due to otherwise nonuniformly distributed masses may thus be advantageously avoided.

In a further method step, annular element 54 is reinserted into rotor body 4; i.e., damper ring 28 is inserted into groove 26, humps 48 (or upwardly bent partial regions 49) then engaging in recess 44 and lying against oppositely situated ends 56 of recess 44. Humps 48 thus prevent damper ring 28 from twisting or moving in the clockwise and counterclockwise directions in circumferential direction 58.

This lock against rotation in particular prevents end 30 of damper ring 28 from sinking into chamfered region 42, which would once again result in formation of notches 40 at that location, or would cause end 30 of damper ring 28 to move past blades 8 into the annular space, resulting in consequential damage to rotor 4 and to blades 8. The service life of rotor 2 may thus be prolonged.

Rotor 2 may then be placed back into operation.

Use of the present invention on retaining plates 18 or the locking plates would be represented in exactly the same way as described above in conjunction with FIGS. 1 through 4. Essentially, the only difference would be that damper ring 28 would be replaced by a retaining plate 18 or a locking plate.

In the present context, "one" does not exclude a plurality. It is further noted that features or steps which have been described in conjunction with one of the above exemplary embodiments may also be used in combination with features or steps of other exemplary embodiments described above. The refinements and exemplary embodiments described above for the method correspondingly apply to the annular element and the rotor system, and vice versa.

The invention claimed is:

1. A method for repairing a rotor system of a turbomachine having a rotor with a groove extending in a circumferential direction of the rotor for accommodating an annular section, the method comprising the following steps:

chamfering a notch in the groove;

introducing a recess into the groove; and inserting the annular section into the groove, at least one engagement element formed on the annular section engaging in the recess to lock against rotation in the circumferential direction.

2. The method as recited in claim 1 wherein the at least one engagement element is mounted on the annular section before the annular section is inserted into the groove.

3. The method as recited in claim 2 wherein the at least one engagement element is mounted by welding or soldering.

4. The method as recited in claim 1 wherein the at least one engagement element is formed by shaping of a partial region of the annular section.

5. The method as recited in claim 4 wherein the shaping is a bending.

6. The method as recited in claim 1 wherein the recess is introduced into a flange in the groove opposite from the notch in such a way that a tool for chamfering the notch is movable essentially in a straight line through the recess to the notch.

7. An annular element for a rotor system of a turbomachine, the annular element comprising:

an annular section insertable into a groove extending in a circumferential direction of a rotor of the rotor system, the groove having a base and two opposing sides extending radially from the base, the annular section having two opposing lateral faces fef contacting the opposing sides of the groove; and at least one engagement element engagable in a recess in the groove to lock the annular section against rotation in the circumferential direction.

8. The annular element as recited in claim 7 wherein the at least one engagement element is a hump extending from the annular section in an axial direction.

9. The annular element as recited in claim 7 wherein the at least one engagement element includes two first interspaced engagement elements on the annular section designed to lie against oppositely situated ends of the recess after the annular section has been inserted into the groove.

10. The annular element as recited in claim 9 wherein the at least one engagement element further includes two second interspaced engagement elements, the first and second engagement elements being situated on the annular section essentially mirror-symmetrically with respect to two mutually perpendicular axes intersecting a ring center point.

11. The annular element as recited in claim 7 wherein the annular section is a damper ring, a retaining plate for at least one blade of the rotor system, or a locking plate of the rotor system.

12. A rotor system for a turbomachine, the rotor system comprising:

a rotor having the groove extending in a circumferential direction of the rotor, the groove being provided with the recess; and an annular element as recited in claim 7, the annular section being inserted into the groove and the at least one engagement element engaging in the recess, and together with the recess forming a lock against rotation in the circumferential direction.

13. The rotor system as recited in claim 12 wherein the groove has a chamfered region on one the opposing sides, and the recess is located on the other of the opposing sides opposite the chamfered region.

14. The annular element as recited in claim 7 wherein the annular section is a damper ring.

15. A rotor system for a turbomachine, the rotor system comprising:

a rotor having a groove extending in a circumferential direction of the rotor, the groove being provided with a chamfered region and a recess; and an annular element having an annular section inserted into the groove extending in a circumferential direction of a rotor of the rotor system to directly contact the groove and having at least one engagement element engaged in the recess in the groove to lock the annular section against rotation in the circumferential direction.

16. The rotor system as recited in claim 15 wherein the chamfered region is located opposite the recess in the groove.

* * * * *